US007530361B2

(12) United States Patent
Killeen et al.

(10) Patent No.: US 7,530,361 B2
(45) Date of Patent: May 12, 2009

(54) DETERGENT COMPOSITION CONTAINING BRANCHED ALCOHOL ALKOXYLATE AND COMPATIBILIZING SURFACTANT, AND METHOD FOR USING

(75) Inventors: Yvonne Killeen, South St. Paul, MN (US); Kim R. Smith, Woodbury, MN (US); Max Guzman, Farmington, MN (US); Steven E. Lentsch, St. Paul, MN (US)

(73) Assignee: Ecolab Inc., Eagan, MN (US)

( * ) Notice: Subject to any disclaimer, the term of this patent is extended or adjusted under 35 U.S.C. 154(b) by 18 days.

(21) Appl. No.: 11/605,705

(22) Filed: Nov. 29, 2006

(65) Prior Publication Data

US 2007/0123447 A1 May 31, 2007

Related U.S. Application Data

(60) Provisional application No. 60/741,131, filed on Nov. 30, 2005.

(51) Int. Cl.

| | |
|---|---|
| ***B08B 3/04*** | (2006.01) |
| ***C11D 1/72*** | (2006.01) |
| ***C11D 1/722*** | (2006.01) |
| ***C11D 7/06*** | (2006.01) |

(52) U.S. Cl. ..... 134/25.2; 134/25.3; 134/42; 510/360; 510/421; 510/475; 510/483

(58) Field of Classification Search ..... 510/360, 510/421, 475, 483; 134/25.2, 42, 25.3
See application file for complete search history.

(56) References Cited

U.S. PATENT DOCUMENTS

| | | | |
|---|---|---|---|
| 3,048,548 | A | 8/1962 | Martin et al. |
| 3,334,147 | A | 8/1967 | Brunelle et al. |
| 3,442,242 | A | 5/1969 | Laskey et al. |
| 5,468,423 | A | 11/1995 | Garabedian, Jr. et al. |
| 5,977,048 | A | 11/1999 | Welch et al. |
| 6,387,870 | B1 | 5/2002 | Klaers et al. |
| 6,413,908 | B1 | 7/2002 | Reekmans et al. |
| 6,440,910 | B1 | 8/2002 | Smith et al. |
| 6,525,015 | B2 | 2/2003 | Man et al. |
| 6,608,023 | B2 | 8/2003 | Klaers et al. |
| 6,673,760 | B1 | 1/2004 | Lentsch et al. |
| 6,716,805 | B1 | 4/2004 | Sherry et al. |
| 6,737,553 | B1 | 5/2004 | Maas et al. |
| 6,786,223 | B2 | 9/2004 | Klinkhammer et al. |
| 6,881,711 | B1 | 4/2005 | Gershun et al. |
| 6,906,230 | B1 | 6/2005 | Maas et al. |
| 2004/0186325 | A1 | 9/2004 | Maas et al. |

FOREIGN PATENT DOCUMENTS

| | | | |
|---|---|---|---|
| DE | 2243307 | | 3/1974 |
| DE | 2301728 | | 7/1974 |
| DE | 2916656 | | 11/1980 |
| EP | 0 709 450 | A1 | 5/1996 |
| WO | 96/18711 | | 6/1996 |
| WO | WO96/18711 | | 6/1996 |
| WO | WO 96/18711 | * | 6/1996 |
| WO | WO02/081610 | | 10/2002 |
| WO | WO2004/099355 | | 11/2004 |
| WO | WO 2004/099355 | * | 11/2004 |

OTHER PUBLICATIONS

"Lutensol XP® Surfactants", BASF The Chemical Company, 10 pages, (Sep. 2005).
"Lutensol XP® Lutensol XL® Nonionic Surfactants for Household Cleaners and I&I Formulators", BASF The Chemical Company, 8 pages.

* cited by examiner

*Primary Examiner*—Brian P Mruk
(74) *Attorney, Agent, or Firm*—Faegre & Benson LLP

(57) ABSTRACT

A detergent composition is provided according to the invention. The detergent composition includes a branched alcohol alkoxylate having the formula:

$$CH_3(CH_2)_nCH(R^1)CH_2O(CH_2CH(R^2)O)_mH$$

wherein $R^1$ is a $C_2$-$C_{20}$ alkyl, $R^2$ is H or a $C_1$-$C_4$ alkyl, n is 2-20, and m is 1-40, and a compatibililizing surfactant. The compatibilizing surfactant can be selected so that an aqueous composition containing 5 wt. % of the branched alcohol alkoxylate and at least 2.5 wt. % of the compatibilizing surfactant provides a clear aqueous composition. A clear aqueous composition refers to an aqueous composition that is free of haze visible to the naked eye. In general, a clear aqueous composition resembles a composition containing only water. A method for using the detergent composition is provided.

23 Claims, No Drawings

DETERGENT COMPOSITION CONTAINING BRANCHED ALCOHOL ALKOXYLATE AND COMPATIBILIZING SURFACTANT, AND METHOD FOR USING

CROSS REFERENCE TO RELATED APPLICATIONS

This application claims priority to U.S. Application Ser. No. 60/741,131 that was filed with the United States Patent and Trademark Office on Nov. 30, 2005. The entire disclosure of U.S. Application Ser. No. 60/741,131 is incorporated herein by reference.

FIELD OF THE INVENTION

This invention relates to a detergent composition and to a method for using a detergent composition. The detergent composition contains a branched alcohol alkoxylate and a compatibilizing surfactant.

BACKGROUND OF THE INVENTION

Guerbet nonionic surfactants have been known for years. Various techniques are available for producing Guerbet nonionic surfactants. For example, see U.S. Pat. No. 6,906,230 to Maas et al., U.S. Pat. No. 6,737,553 to Maas et al., and U.S. Pat. No. 5,977,048 to Welch et al.

Aqueous compositions containing Guerbet nonionic surfactants have a tendency to deposit on surfaces and form a greasy film. This tendency has limited the use of Guerbet nonionic surfactants as detergents.

Liquid detergent compositions containing Guerbet nonionic surfactants have been disclosed. For example, see EP 0 709 450.

SUMMARY OF THE INVENTION

A detergent composition is provided according to the invention. The detergent composition includes a branched alcohol alkoxylate having the formula:

$$CH_3(CH_2)_n\underset{\underset{R^1}{|}}{C}HCH_2O(CH_2\underset{\underset{R^2}{|}}{C}HO)_mH$$

wherein $R^1$ is a $C_2$-$C_{20}$ alkyl, $R^2$ is H or a $C_1$-$C_4$ alkyl, n is 2-20, and m is 1-40, and a compatibililizing surfactant. The compatibilizing surfactant can be selected so that an aqueous composition containing 5 wt. % of the branched alcohol alkoxylate and at least 2.5 wt. % of the compatibilizing surfactant provides a clear aqueous composition. A clear aqueous composition refers to an aqueous composition that is free of haze visible to the naked eye. In general, a clear aqueous composition is a composition having a clarity similar to a composition containing only water.

A method for using the detergent composition is provided according to the invention. The method includes a step of diluting a concentrate of the detergent composition with water to provide a use composition, and applying the use composition to a soiled surface.

DETAILED DESCRIPTION OF THE INVENTION

The detergent composition can be used in a wide variety of cleaning and sanitizing fomulations, including laundry detergents, fabric softeners, fabric presoaks, dryer sheets, bleaches, hard surface cleaners, glass cleaners, floor strippers, film-forming coatings, handsoaps, skin lotions, sanitizers/disinfectants, dish detergents, carpet cleaners, and vehicle cleaners.

The detergent composition can be provided as a concentrate or as a use composition. In general, a concentrate refers to a composition that is intended to be diluted with water to provide a use composition. A use composition refers to a composition that can be applied to articles or surfaces to provide detersive activity. In general, a use composition can have a solids content of less than about 90 wt. %. The phrase solids content refers to the weight percent of non-water components.

The use composition can be applied to various soiled surfaces. Exemplary soiled surfaces include fabrics and hard surfaces. Exemplary hard surfaces include toilet bowls, baths, shower surrounds and other plumbing fixtures, bathroom and kitchen hard surfaces (e.g., countertops), glass windows, and floor surfaces.

The detergent composition includes a branched alcohol alkoxylate and a compatibilizing surfactant. The detergent composition can include additional components such as source of alkalinity, chelating/sequestering agents and threshold agents, wetting agents, foam modifiers, corrosion inhibitors, anti-redeposition agents, pH modifiers, viscosity modifiers, antimicrobials, bleaches, bleach activators, soil penetrants, emulsifiers, film forming agents, organic solvents, solidification aids, processing aids, and dyes, pigments, and fragrances.

Branched Alcohol Alkoxylate

The branched alcohol alkoxylate has the following formula:

$$CH_3(CH_2)_n\underset{\underset{R^1}{|}}{C}HCH_2O(CH_2\underset{\underset{R^2}{|}}{C}HO)_mH$$

wherein $R^1$ is a $C_2$-$C_{20}$ alkyl, $R^2$ is H or a $C_1$-$C_4$ alkyl, n is 2-20, and m is 1-40. The branched alcohol alkoxylates can be considered a type of nonionic surfactant. The branched alcohol alkoxylates include those nonionic surfactants that can be prepared according to U.S. Pat. No. 6,906,320 to Maas et al., U.S. Pat. No. 6,737,553 to Maas et al., and U.S. Pat. No. 5,977,048 to Welch et al. The disclosure of these patents is incorporated herein by reference. Exemplary branched alcohol alkoxylates include those available under the name Lutensol XP30, Lutensol XP-50, and Lutensol XP-80 available from BASF Corporation. In general, Lutensol XP-30 can be considered to have 3 repeating ethoxy groups, Lutensol XP-50 can be considered to have 5 repeating ethoxy groups, and Lutensol XP-80 can be considered to have 8 repeating ethoxy groups.

Branched alcohol alkoxylates can be classified as relatively water insoluble or relatively water soluble. In general, a water insoluble branched alcohol alkoxylate can be considered an alkoxylate that, when provided as a composition containing 5 wt. % of the branched alcohol alkoxylate and 95 wt. % water, has a tendency to deposit on a surface and form a greasy film. Lutensol XP-30 and Lutensol XP-50 from BASF Corporation can be considered water insoluble branched alcohol alkoxylates. A branched alcohol alkoxylate that does not have a tendency to deposit on a surface and form a greasy film when provided as a composition containing 5 wt. % of the branched alcohol alkoxylate and 95 wt. % water can be considered a water soluble branched alcohol alkoxylate. Lutensol XP-80 from BASF Corporation can be considered a water soluble branched alcohol alkoxylate.

The detergent composition can be provided having a sufficient amount of the branched alcohol alkoxylate to impart desired detersive properties when the composition is provided as a use composition. As a concentrate, the detergent composition can contain about 2 wt. % to about 50 wt. % of the branched alcohol alkoxylate, about 3 wt. % to about 40 wt. % of the branched alcohol alkoxylate, and about 5 wt. % to about 30 wt. % of the branched alcohol alkoxylate.

Compatibilizing Surfactant

The detergent composition contains a compatibilizing surfactant to help hold the branched alcohol alkoxylate in solution. In general, the compatibilizing surfactant can be selected so that an aqueous composition containing 5 wt. % of the branched alcohol alkoxylate and at least 2.5 wt. % of the compatibilizing surfactant provides a clear aqueous composition. A clear aqueous composition refers to a composition that is substantially free of haze. By substantially free of haze, it is meant that one would not perceive the composition as hazy by simply viewing a 100 gram sample of the aqueous composition. In general, a clear composition can be considered to have a similar absence of haze compared to a composition containing 100% water.

Exemplary compatibilizing surfactants include anionic surfactants, cationic surfactants, nonionic surfactants, amphoteric surfactants, or mixtures thereof.

Exemplary anionic surfactants that may be used include sulfonates, sulfates, carboxylates, phosphates, taurates, or mixtures thereof.

Exemplary cationic surfactants that may be used include quaternary ammonium compounds, amine salts, phosphonium compounds, or mixtures thereof.

Exemplary nonionic surfactants that may be used include alcohol alkoxylates; alkyl phenol alkoxylates; copolymers of at least two of ethylene oxide, propylene oxide, and butylene oxide; ethylene oxide/propylene oxide copolymer; polyglycosides, derivatives of polyglycosides; fatty amides; fatty esters; fatty amines; sorbitan derivatives; or mixtures thereof.

Exemplary amphoteric surfactants that may be used include betaines, sulfobetaines, sultaines, amine oxides, amino acid derivatives, phosphobetaines, amphoacetates, amphopropionates, imidazoline derivatives, etc., and mixtures thereof.

An exemplary compatibilizing surfactant that can be used includes linear alcohol alkoxylates. Exemplary linear alcohol alkoxylates include those having $C_5$-$C_{20}$ alkyl group and 3 to 20 repeating alkoxy groups such as repeating ethoxy groups. An exemplary linear alcohol ethoxylate having $C_5$-$C_{20}$ alkyl group and 3-20 repeating ethoxy groups can be referred to as a $C_{5-20}$ $EO_{3-20}$ linear alcohol ethoxylate.

The compatibilizing surfactant can be provided in an amount sufficient to help hold the branched alcohol alkoxylate in the resulting detergent composition to reduce the tendency of the branched alcohol alkoxylate to deposit on a surface and form a greasy film. Minimally, an amount of the compatibilizing surfactant can be used to help hold the branched alcohol alkoxylate in the detergent composition. Additional amounts of the compatibilizing surfactant beyond the amount necessary to reduce deposition by the branched alcohol alkoxylate can be used. Furthermore, it is expected that the maximum amount of the compatibilizing surfactant may be selected to avoid causing the composition to cost too much. For example, the concentrate can include about 1 wt. % to about 20 wt. % of the compatibilizing surfactant, about 2 wt. % to about 15 wt. % of the compatibilizing surfactant, and about 5 wt. % to about 12 wt. % of the compatibilizing surfactant. In addition, a preferred compatibilizing surfactant includes the linear alcohol alkoxylate surfactants. The concentrate can include about 1 wt. % to about 20 wt. % of the linear alcohol alkoxylate, about 2 wt. % to about 15 wt. % of the linear alcohol alkoxylate, and about 5 wt. % to about 12 wt. % of the linear alcohol alkoxylate.

The amount of the compatibilizing surfactant can be selected so that the weight ratio of the compatibilizing surfactant to the branched alcohol alkoxylate is at least about 0.5:1. The weight ratio of the compatibilizing surfactant to the branched alcohol alkoxylate can be greater than about 1:1, and can be greater than about 2:1.

Source of Alkalinity

The detergent composition can include a source of alkalinity. Exemplary sources of alkalinity include alkali metal hydroxides and alkaline earth metal hydroxides. Exemplary alkali metal hydroxides include, for example, sodium or potassium hydroxide. Suitable alkaline earth metal hydroxides include, for example, magnesium hydroxide. An alkali or alkaline earth metal hydroxide may be added to the composition in the form of solid beads, dissolved in an aqueous solution, or a combination thereof. Alkali and alkaline earth metal hydroxides are commercially available as a solid in the form of prilled beads having a mix of particle sizes ranging from about 12-100 U.S. mesh, or as an aqueous solution, as for example, as a 50 wt. % and a 73 wt. % solution. It is preferred that the alkali or alkaline earth metal hydroxide is added in the form of an aqueous solution, preferably a 50 wt. % hydroxide solution, to reduce the amount of heat generated in the composition due to hydration of the solid alkali material.

The detergent composition can include an alkaline source other than an alkali metal hydroxide. Examples of other alkaline sources include a metal silicate such as sodium or potassium silicate or metasilicate, a metal carbonate such as sodium or potassium carbonate, bicarbonate or sesquicarbonate, and the like; a metal borate such as sodium or potassium borate, and the like; ethanolamines and amines; and other like alkaline sources. Alkalinity agents are commonly available in either aqueous or powdered form, either of which is useful in formulating the present cleaning compositions.

The detergent composition can be provided without a source of alkalinity. When the detergent concentrate includes a source of alkalinity, it can be included in an amount of about 4 wt. % to about 70 wt. %, about 5 wt. % to about 60 wt. %, and about 10 wt. % to about 50 wt. %.

Chelating/Sequestering Agents and Threshold Agents

The composition may include a chelating/sequestering agent. In general, a chelating agent is a molecule capable of coordinating (i.e., binding) the metal ions commonly found in natural water to prevent the metal ions from interfering with the action of the other detersive ingredients of a detergent composition. Exemplary chelating/sequestering agents that can be used include an aminocarboxylic acid, a condensed phosphate, a phosphonate, and an organic hydroxycarboxylic acid. Threshold agents can be used to reduce interference of detersive ingredients by metal ions. An exemplary threshold agent that can be used includes a polyacrylate.

Useful aminocarboxylic acids include, for example, n-hydroxyethyliminodiacetic acid, nitrilotriacetic acid (NTA), ethylenediaminetetraacetic acid (EDTA), N-hydroxyethylethylenediaminetriacetic acid (HEDTA), diethylenetriaminepentaacetic acid (DTPA), and the like. Examples of condensed phosphates useful in the present composition include, for example, sodium and potassium orthophosphate, sodium and potassium pyrophosphate, sodium tripolyphosphate, sodium hexametaphosphate, and the like.

Useful hydroxycarboxylic acids that can be used include, for example, citric acid, salts of citric acid, hydroxycetic acid, salts of hydroxycetic acid, and succinic acid, and salts of succinic acid.

The composition may include a phosphonate such as aminotris(methylene phosphonic acid), hydroxyethylidene diphosphonic acid, ethylenediaminetetra(methylene phosphonic acid), diethylenetriaminepente(methylene phosphonic acid), and the like. It is preferred to use a neutralized or alkaline phosphonate, or to combine the phosphonate with an alkali source prior to being added into the mixture such that there is little or no heat generated by a neutralization reaction when the phosphate is added.

Exemplary builders and chelants that can be used include organic and inorganic chelating agents. Inorganic chelating agents include, for example, alkali metal phosphates (e.g., phosphate, pyrophosphate, tripolyphosphate), alkali metal aluminosilicates, zeolites, and mixtures thereof. Organic chelating agents include, for example, polymeric and small molecule chelating agents. Polymeric threshold agents include ionomer compositions such as polyacrylic acids compounds and/or acid anhydride copolymers (maleic anhydride/olefin, etc.). Small molecule organic chelating agents include amino-carboxylates such as salts of ethylenediaminetetracetic acid (EDTA) and hydroxyethylenediaminetetracetic acid, nitrilotriacetic acid, ethylenediaminetetrapropionates, triethylenetetraminehexacetates, and the respective alkali metal, ammonium, and substituted ammonium salts thereof. Phosphonates can also be used as chelating agents and include ethylenediamine tetra(methylenephosphonate), nitrilotrismethylenephosphonate, diethylenetriaminepenta(methylenephosphonate), hydroxyethylidene diphosphonate, and 2-phosphonobutane 1,2,4-tricarboxylic acid. The phosphonates commonly contain alkyl or alkylene groups with less than 8 carbon atoms. Preferred chelating agents include the phosphonates, amino-carboxylates, phosphates, and amino-carboxylates. Some chelants such as the phosphonates are also effective threshhold inhibitors, preventing the crystallization/precipitation of calcium salts from the interaction of detergent with hard water.

The detergent composition can be provided without a chelating agent, sequestering agent, builder, or threshold agent. When the detergent composition concentrate includes any of these components, they can be included in an amount of about 0.4 wt. % to about 10 wt. %, about 0.5 wt. % to about 8 wt. %, and about 1 wt. % to about 4 wt. %.

Wetting Agent

The detergent composition can include a wetting agent. An exemplary wetting agent includes lauryl polyglucose.

The detergent composition can be provided without a wetting agent. When the detergent composition concentrate includes a wetting agent, it can be included in an amount of about 0.4 wt. % to about 6 wt. %, about 0.5 wt. % to about 5 wt. %, or about 1 wt. % to about 3 wt. %.

Water

Water can be added to the detergent composition concentrate to form the detergent composition use composition. In general, the use composition refers to the composition that contacts a surface or article to provide detersive activity. It can be advantageous to distribute a detergent composition in the form of a concentrate, and then dilute the concentrate with water to provide a use composition at the situs of use.

The concentrate can be provided without water or it can be provided in a form that contains water. The concentrate can be provided as a powder, a solid, a gel, or a liquid. When the concentrate is provided in the form of a powder, the concentrate can contain about 0 to about 10 wt. % water, about 0.1 wt. % to about 10 wt. % water, or about 0.2 wt. % to about 5 wt. % water. When the concentrate is provided in the form of a solid, the concentrate can contain about 0 to about 50% water, about 5 wt. % to about 30 wt. % water, or about 10 to about 25 wt. % water. When the concentrate is provided as a liquid, the concentrate can contain about 20 wt. % to about 90 wt. % water or about 25 wt. % to about 80 wt. % water. In general, the concentrate can contain water in an amount of less than about 90 wt. %. Above 90 wt. % water, the detergent composition tends to look more like a use composition. It should be understood, however, that the weight percent solids in the use composition can be adjusted to provide a desired level of detersive activity. In certain circumstances, it may be desirable to provide a use composition having a solids content that is less than about 5 wt. %, less than about 3 wt. %, less than about 1 wt. %, less than about 0.5 wt. %, or less than about 0.1 wt. %.

Defoaming Agents and Foam Boosters

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found in U.S. Pat. No. 3,048,548 to Martin et al., U.S. Pat. No. 3,334,147 to Brunelle et al., and U.S. Pat. No. 3,442,242 to Rue et al., the disclosures of both references incorporated by reference herein.

Exemplary foam boosters that can be used include amphoteric surfactants, anionic surfactants, nonionic surfactants, and mixtures thereof. Additional foam boosters include glycol ethers and polymers. Exemplary foam suppressants include silicones and their derivatives, water-insoluble compounds, or nonionic surfactants used at temperatures above their cloud point.

Anti-Redeposition Agents

The detergent composition may also include an anti-redeposition agent capable of facilitating sustained suspension of soils in a cleaning solution and preventing removed soils from being redeposited onto the substrate being cleaned. Examples of suitable anti-redeposition agents include fatty acid amides, fluorocarbon surfactants, complex phosphate esters, polymers or copolymers derived from acid anhydrides such as styrene maleic and hydride copolymer, polymers and copolymers derived from polyacrylates, and cellulosic derivatives such as hydroxyethyl cellulose, hydroxypropyl cellulose, carboxymethyl cellulose, and the like.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical Co.), Fluorescein (Capitol Color and Chemical), Rhodamine (D&C Red No. 19), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, ajasmine such as C1S-jasmine orjasmal, vanillin, and the like.

Hardening Agents

The detergent composition concentrate can be provided as a solid. Solidification of the composition can be accomplished using a hardening agent. Exemplary hardening agents include urea, polyethylene glycol, hydrates of inorganic compounds, and sodium hydroxide. Various inorganics can be used that either impart solidifying properties to the present composition and can be processed into pressed tablets for carrying the alkaline agent. Such inorganic agents include calcium carbonate, sodium sulfate, sodium bisulfate, alkali metal phosphates, anhydrous sodium acetate and other known hydratable compounds.

Additional Components

Various additional components can be included in the detergent compositions including corrosion inhibitors, pH modifiers, viscosity modifiers, antimicrobials, bleaches, soil penetrants, emulsifiers, film forming agents, organic solvents, and processing aids. It should be understood that each of these components can be excluded from the detergent composition, if desired.

Corrosion inhibitors that can be used include amines, triazoles, phosphates, nitrates, metal carboxylates, silicates, and a wide variety of additional material known to one skilled in the art.

pH modifiers that can be used include organic or inorganic acids, bases, or buffering agents. Nonlimiting examples of the acids include citric acid, gluconic acid, hydroxyacetic acid, acetic acid, adipic acid, suflamic acid, phosphoric acid, sulfuric acid, bicarbonates, hydrogen phosphates, bisulfate, hydrochloric acid, polyacrylic acid, etc. Nonlimiting examples of the bases include alkali metal hydroxides, ammonium hydroxide, amines, alkanolamines, ether amines, ethylene diamine and its derivatives, polymeric amines, carbonates, silicates, aluminates, etc.

Viscosity modifiers can be used to increase or decrease the viscosity of a formulation. Exemplary viscosity modifiers include inorganic salts (sodium chloride, sodium sulfate, magnesium sulfate, etc.), polymers (polyacrylates, cellulose derivatives, etc.), gums (guar and guar derivatives, xanthum, etc.), inorganic salts (calcium chloride, etc.) and organic solvents (alcohols, glycol ethers, etc.). An exemplary glycol ether includes diethylene glycol monobutyl ether. The detergent composition can include a viscosity modifier in an amount of about 1 wt. % to about 20 wt. % or about 5 wt. % to about 15 wt. %.

Antimicrobials that can be used include cationic compounds, phenol derivatives, fatty acids, peroxygen compounds, active halogen compounds, preservatives, etc.

Bleaches that can be used include both active oxygen and halogen compounds. They may optionally be activated using a variety of systems known to the art (transition metals, esters, etc.).

Soil penetrants that can be used include those compounds which enhance the permeation of water into a soil. These vary widely with the soil type: amines, EO-PO copolymers, solvents, etc.

Emulsifiers that can be used include surfactants or oils.

Film forming agents that can be used include polyacrylates, polyurethanes, camauba wax, montan wax, polyethylene, polypropylene glycol, etc.

Organic solvents that can be used include terpenes, glycol ethers and their derivatives, mineral spirits, branched paraffins, etc.

Processing aids can be used to improve the manufacturing process of a formulation. They include water, alkali metal carbonates, alkali metal halides, etc.

Exemplary ranges for components of a detergent concentrate are provided in Table 1. The ranges for the components are provided on the basis of the components being 100% active. It is understood that components are often available in a form that contains water. For purposes of the ranges in Table 1, the ranges are based upon the absence of water from the component.

TABLE 1

Exemplary Ranges for Components of Concentrate at 100% Active

| Component | First exemplary range (wt. %) | Second exemplary range (wt. %) | Third exemplary range (wt. %) |
|---|---|---|---|
| Branched alcohol alkoxylate | 2-50 | 3-40 | 5-30 |
| Compatibilizing surfactant | 1-20 | 2-15 | 5-12 |
| Source of alkalinity | 0-70 | 5-60 | 10-50 |
| Chelating agent or threshold agent | 0-10 | 0.5-8 | 1-4 |
| Wetting agent | 0-6 | 0.5-5 | 1-3 |
| Water | 0-90 | 0.1-80 | 0.2-70 |

The detergent composition concentrate can be provided with or without a source of alkalinity such as caustic. An exemplary detergent concentrate containing caustic is shown in Table 2. An exemplary detergent concentrate not containing a source of alkalinity is shown in Table 3. A source of alkalinity such as caustic can be combined with the detergent concentrate shown in Table 3. For example, it is sometimes convenient in laundry washing operations to combine a surfactant stream with a source of alkalinity stream so that the surfactant and the source of alkalinity combine in the laundry washing machine.

TABLE 2

Exemplary Liquid Concentrate Containing Caustic

| Component | Amount (wt. %) |
|---|---|
| Branched alcohol alkoxylate | 10.5 |
| Linear alcohol alkoxylate | 3.5 |
| NaOH (50% active) | 74 |
| Threshold agent (50% active) | 4.0 |
| Chelating agent (50% active) | 6.3 |
| Wetting agent (50% active) | 1.2 |
| Pigment and Optical brightener | 0.05 |

TABLE 3

Exemplary Liquid Concentrate for Combining with Alkalinity

| Component | Amount (wt. %) |
|---|---|
| Branched alcohol alkoxylate | 33 |
| Linear alcohol alkoxylate | 16 |
| Chelating agent | 10 |

TABLE 3-continued

| Exemplary Liquid Concentrate for Combining with Alkalinity | |
|---|---|
| Component | Amount (wt. %) |
| Thickener | 9 |
| Water | 32 |

The use levels of the primary alcohol alkoxylate/compatibilizing surfactant blend in a formulation should be such that a benefit (cleaning, wetting, de-wetting, leveling, softening, biocidal, foaming, de-foaming, coating, protecting, etc.) is provided.

The compositions may be dispensed from single or multi-use packaging in a variety of physical forms: liquid, gel, paste, solid, powder, agglomerate, foam, aerosol. Further, they may be prepared as a concentrate for dilution at the point of use or manufactured as a ready-to-use product. Optionally, the compositions may be contained within water-soluble packaging.

The following examples and data further illustrate the practice of the invention, should not be taken as limiting the invention and contains the best mode. The following examples and data show the effectiveness of the invention in promoting adequate ability to remove a soil.

EXAMPLE 1

Solubilization of Ethoxylated 1-hydroxy-2-propyl-heptane

Ethoxylated 1-hydroxy-2-propyl-heptane (Lutensol XP-50 from BASF Corporation) is a branched alcohol ethoxylate difficult to incorporate into a hard surface cleaner. Various surfactants were used to solubilize the branched alcohol ethoxylate under ambient conditions (room temperature, 1 atmosphere). About half a gram of dirty motor oil was placed on an aluminum coupon and was immersed in a detergent solution for 5 minutes. The coupon was then carefully removed and immediately photographed to show remaining oil. Several compositions were more effective than compositions containing nonyl phenol ethoxylate (NPE 9.5) as a surfactant. Several compositions were more effective for removing dirty motor oil than two commercial products (Simple Green Automotive Cleaner from Simple Green and Panther from Ecolab Inc.).

The results of this example are reported in Table 4. In addition, Lutensol XP-50 is a Guerbet ethoxylate from BASF Corporation and contains 5 ethoxy groups. Lutensol XP-80 is a Guerbet ethoxylate from BASF Corporation containing 8 ethoxy groups. Lutensol XP-50 can generally be considered water insoluble, and Lutensol XP-80 can generally be considered water soluble.

TABLE 4

| Water (g) | Water Insoluble Alkoxylate (g) | Water Insoluble Surfactant (g) |
|---|---|---|
| 50 | 2.5 Lutensol XP-50 | 7.5 $C_{12}$-$C_{14}$ 7 EO Surfonic L24-7 Huntsmen Chemical |
| 50 | 2.5 Lutensol XP-50 | >14 g $C_{12}$-$C_{14}$ 5 EO Surfonic L24-7 Huntsmen Chemical |

TABLE 4-continued

| Water (g) | Water Insoluble Alkoxylate (g) | Water Insoluble Surfactant (g) |
|---|---|---|
| 50 | 2.5 Lutensol XP-50 | >14 g $C_{12}$-$C_{14}$ 3 EO Surfonic L24-7 Huntsmen Chemical |
| 50 | 2.5 Lutensol XP-50 | >14 g $C_{10}$ 3EO |
| 50 | 2.5 Lutensol XP-50 | 4.8 g Tergitol $C_{15}$ S (secondary) 7 EO Dow Chemical |
| 50 | 2.5 Lutensol XP-50 | 3.1 g $C_{10}$-$C_{12}$ 21 EO |
| 50 | 2.5 Lutensol XP-50 | 1.7 g Pluronic N3 |
| 50 | 2.5 Lutensol XP-50 | 1.5 g Pluronic L61 |
| 50 | 2.5 Lutensol XP-50 | 2.27 g C12 amine oxide, 30% |
| 50 | 2.5 Lutensol XP-50 | 1.89 g alpha olefin sulfonate, 40% |
| 50 | 2.5 Lutensol XP-50 | 5.53 g cocotrimethyl quat, 27% |
| 50 | 2.5 g $C_{12}C_{14}$ 3EO | 8.10 g Lutensol XP-80[2] (8EO) |

EXAMPLE 2

Ethoxylated 1-hydroxy-2-propyl-heptane/Laureth-myristeth-9 EO in a Laundry Detergent A laundry detergent composition containing branched alcohol ethoxylates (Lutensol XP-50) and linear fatty alcohol surfactant containing $C_{12-14}$ alkyl and 9 ethoxy groups (Surfonic L24-9) was compared to a detergent composition containing nonyl phenol ethoxylate (NPE-9.5) for cleaning cotton fabric swatches soiled with makeup and dust-sebum using a tergotometer (U.S. Testing Co.). The cleaning was quantitated as the final reflectance of swatches after a 10 minute wash at 120° F. and 1 g detergent/liter wash water and then the % soil removed calculated. The compositions are reported in Table 5, and the results are reported in Table 6. The data below illustrates that the compositions according to the invention can be used to obtain satisfactory cleaning results at a reduced use level compared to traditional water-soluble surfactants such as nonylphenol ethoxylate.

TABLE 5

| Compositions A and B | | |
|---|---|---|
| Component | A (wt. %) | B (wt. %) |
| water | 20.0 | 21.0 |
| NaOH, 50% | 60.0 | 60.0 |
| NPE-9.5 | 20.0 | 0 |
| Surfonic L24-9 | 0 | 3.5 |
| Lutensol XP-50[1] | 0 | 10.5 |

TABLE 6

| Results | | |
|---|---|---|
| Compositions | % removed: dust-sebum/cotton | % removed: makeup |
| A | 42% | 65% |
| B | 50% | 59% |

The invention claimed is:

1. A detergent composition comprising:

(a) a water insoluble branched alcohol alkoxylate having the formula:

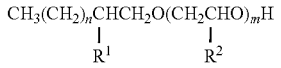

wherein $R^1$ is a $C_2$-$C_{20}$ alkyl, $R^2$ is H or a $C_1$-$C_4$ alkyl, n is 2-20, and m is 1-5;

(b) a compatibilizing surfactant, wherein the compatibilizing surfactant is selected so that an aqueous composition containing 5 wt. % of the branched alcohol alkoxylate and at least 2.5 wt. % of the compatibilizing surfactant provides a clear aqueous composition; and (c) about 1 wt. % to about 20 wt. % of a viscosity modifier.

2. A detergent composition according to claim 1, wherein the compatibilizing surfactant comprises at least one of a linear alcohol alkoxylate or an ethylene oxide/propylene oxide copolymer.

3. A detergent composition according to claim 2, wherein the linear alcohol alkoxylate contains an alkyl group having 5 to 20 carbon atoms, and 2 to 20 repeating ethoxy groups.

4. A detergent composition according to claim 1, wherein the composition comprises about 2 wt. % to about 50 wt. % of the branched alcohol alkoxylate.

5. A detergent composition according to claim 1, wherein the detergent composition comprises about 1 wt. % to about 20 wt. % of the compatibilizing surfactant.

6. A detergent composition according to claim 2, wherein the detergent composition comprises about 1 wt. % to about 20 wt. % of the linear alcohol alkoxylate.

7. A detergent composition according to claim 1, wherein the detergent composition comprises about 0.5 wt. % to about 10 wt. % of a chelating/sequestering agent or a threshold agent.

8. A detergent composition according to claim 1, wherein the detergent composition comprises about 0.5 wt. % to about 6 wt. % wetting agent.

9. A detergent composition according to claim 1, wherein the detergent composition comprises about 0.1 wt. % to about 90 wt. % water.

10. A detergent composition according to claim 1, wherein the detergent composition comprises about 5 wt. % to about 70 wt. % of a source of alkalinity.

11. A method for using a detergent composition comprising:

(a) diluting a detergent composition concentrate with water to provide a detergent composition use composition, the detergent composition concentrate comprising:

(i) an alcohol alkoxylate having the formula:

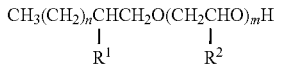

wherein $R^1$ is a $C_2$-$C_{20}$ alkyl, $R^2$ is H or a $C_1$-$C_4$ alkyl, n is 2-20, and m is 1-5;

(ii) a compatibilizing surfactant, wherein the compatibilizing surfactant is selected so that an aqueous composition containing 5 wt. % of the branched alcohol alkoxylate and at least 2.5 wt. % of the compatibilizing surfactant provides a clear aqueous composition; and (iii) about 1 wt. % to about 20 wt. % of a viscosity modifier; and (b) applying the use composition to a soiled substrate.

12. A method for using a detergent composition according to claim 11, wherein the compatibilizing surfactant comprises at least one of a linear alcohol alkoxylate or ethylene oxide/propylene oxide copolymer.

13. A method for using a detergent composition according to claim 12, wherein the linear alcohol alkoxylate contains an alkyl group having 5 to 20 carbon atoms, and 2 to 20 repeating ethoxy groups.

14. A method for using a detergent composition according to claim 11, wherein the composition comprises about 2 wt. % to about 50 wt. % of the branched alcohol alkoxylate.

15. A method for using a detergent composition according to claim 11, wherein the detergent composition comprises about 1 wt. % to about 20 wt. % of the compatibilizing surfactant.

16. A method for using a detergent composition according to claim 12, wherein the detergent composition comprises about 1 wt. % to about 20 wt. % of the linear alcohol alkoxylate.

17. A method for using a detergent composition according to claim 11, wherein the detergent composition comprises about 0.5 wt. % to about 10 wt. % of a chelating/sequestering agent or a threshold agent.

18. A method for using a detergent composition according to claim 11, wherein the detergent composition comprises about 0.5 wt. % to about 6 wt. % wetting agent.

19. A method for using a detergent composition according to claim 11, wherein the detergent composition comprises about 0.1 wt. % to about 90 wt. % water.

20. A method for using a detergent composition according to claim 11, wherein the detergent composition comprises about 5 wt. % to about 70 wt. % of a source of alkalinity.

21. A detergent composition comprising:

(a) a water insoluble branched alcohol alkoxylate having the formula:

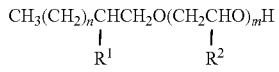

wherein $R^1$ is a $C_2$-$C_{20}$ alkyl, $R^2$ is H or a $C_1$-$C_4$ alkyl, n is 2-20, and m is 1-5;

(b) a compatibilizing surfactant, wherein the compatibilizing surfactant is selected so that an aqueous composition containing 5 wt. % of the branched alcohol alkoxylate and at least 2.5 wt. % of the compatibilizing surfactant provides a clear aqueous composition;

(c) a chelating/sequestering agent or a threshold agent; and (d) a source of alkalinity.

22. A detergent composition according to claim 21, wherein the detergent composition comprises about 0.5 wt. % to about 10 wt. % of a chelating/sequestering agent or a threshold agent.

23. A detergent composition according to claim 21, wherein the detergent composition comprises about 5 wt. % to about 70 wt. % of a source of alkalinity.

* * * * *